US012044514B2

(12) United States Patent
Bollfrass

(10) Patent No.: US 12,044,514 B2
(45) Date of Patent: Jul. 23, 2024

(54) PROJECTILE FOR DEPOSITION OF ELECTRICALLY DISRUPTIVE MATERIAL AND METHOD OF MAKING THE SAME

(71) Applicant: Charles Barton Bollfrass, Austin, TX (US)

(72) Inventor: Charles Barton Bollfrass, Austin, TX (US)

( * ) Notice: Subject to any disclaimer, the term of this patent is extended or adjusted under 35 U.S.C. 154(b) by 11 days.

(21) Appl. No.: 18/057,620

(22) Filed: Nov. 21, 2022

(65) Prior Publication Data

US 2024/0019232 A1 Jan. 18, 2024

Related U.S. Application Data

(60) Provisional application No. 63/305,147, filed on Jan. 31, 2022.

(51) Int. Cl.
*F42B 12/74* (2006.01)
*C22C 1/04* (2023.01)

(52) U.S. Cl.
CPC ..... *F42B 12/74* (2013.01); *C22C 1/04* (2013.01)

(58) Field of Classification Search
CPC ..... F42B 12/02; F42B 12/36; F42B 12/46; F42B 12/74
See application file for complete search history.

(56) References Cited

U.S. PATENT DOCUMENTS 1,088,025 A * 2/1914 Johnson ..... F42B 12/40 102/513
2,105,528 A * 1/1938 Foisy ..... F42B 12/74 86/39
3,898,933 A * 8/1975 Castera ..... F42B 8/16 102/529
5,225,628 A * 7/1993 Heiny ..... F42B 7/10 102/438
5,375,529 A * 12/1994 Knight, Jr. ..... F42B 8/16 102/513
5,654,524 A * 8/1997 Saxby ..... F42B 12/40 102/513
6,230,630 B1 * 5/2001 Gibson ..... F42B 12/40 102/478
6,543,365 B1 * 4/2003 Vasel ..... F41B 11/62 102/370
6,722,283 B1 * 4/2004 Dindl ..... F42B 5/145 102/370
7,089,863 B1 * 8/2006 Dindl ..... F42B 8/14 102/524
7,121,211 B2 * 10/2006 Beal ..... F42B 12/24 102/493
7,383,775 B1 * 6/2008 Mock, Jr. ..... F42B 12/367 102/491

(Continued)

*Primary Examiner* — Joshua E Freeman
(74) *Attorney, Agent, or Firm* — Workman Nydegger

(57) ABSTRACT

An electrically disruptive projectile for use with a firearm can include a body defining a cavity. The cavity may be filled with an electrically disruptive powder, including conductive, superconductive, triboelectric, and/or piezoelectric materials. The electrically disruptive powder may be secured in the cavity by a cover or film in an opening of the cavity, and is positioned to disperse into a target upon penetration through an exterior of the target. The electrically disruptive powder may create new electrical pathways and signals in the target.

20 Claims, 6 Drawing Sheets

(56) References Cited

U.S. PATENT DOCUMENTS

| | | | | |
|---|---|---|---|---|
| 8,875,634 | B2 * | 11/2014 | Gibson | F42B 12/40 102/513 |
| 8,881,654 | B2 * | 11/2014 | Seecamp | F42B 12/36 102/508 |
| 9,200,877 | B1 * | 12/2015 | Rubin | F42B 12/46 |
| 9,200,878 | B2 * | 12/2015 | Seecamp | F42B 12/34 |
| 10,060,715 | B1 * | 8/2018 | Davis | F42B 12/74 |
| 10,641,591 | B1 * | 5/2020 | Rubin | F42B 12/46 |
| 2003/0047105 | A1 * | 3/2003 | Vasel | F41B 11/57 102/502 |
| 2005/0016412 | A1 * | 1/2005 | Vasel | F42B 7/08 102/502 |
| 2005/0066841 | A1 * | 3/2005 | Vasel | F42B 12/50 102/502 |
| 2005/0188886 | A1 * | 9/2005 | Vasel | F41B 11/57 102/502 |
| 2006/0278116 | A1 * | 12/2006 | Hunt | F42B 12/38 102/512 |
| 2008/0141889 | A1 * | 6/2008 | Beal | F42B 12/34 102/439 |
| 2010/0108352 | A1 * | 5/2010 | McCahon | F42B 12/36 337/28 |
| 2013/0092041 | A1 * | 4/2013 | Seecamp | F42B 30/02 102/501 |
| 2013/0291755 | A1 * | 11/2013 | Hirlinger | F42B 8/12 102/513 |
| 2017/0045346 | A1 * | 2/2017 | Aw | F42B 12/36 |
| 2018/0202785 | A1 * | 7/2018 | Omonira | F42B 12/54 |
| 2018/0292184 | A1 * | 10/2018 | Down | F42B 12/36 |

* cited by examiner

PROJECTILE FOR DEPOSITION OF ELECTRICALLY DISRUPTIVE MATERIAL AND METHOD OF MAKING THE SAME

CROSS REFERENCE TO RELATED APPLICATIONS

This application claims the benefit and priority of U.S. provisional application No. 63/305,147 filed Jan. 31, 2022. The noted priority application is incorporated herein by reference in its entirety.

TECHNICAL FIELD

The disclosure relates to electrically disruptive projectiles, such as bullets, shot, slugs, or other ammunition.

BACKGROUND

Bullets have been designed with specially tailored features for accomplishing a wide variety of objectives related to hunting, sporting, personal defense, law enforcement and military applications. Known bullet designs are largely concerned with inflicting mechanical trauma to a target by tuning a bullet's composition and shape to achieve a particular penetration of and energy transfer to the target.

Hunting bullets are generally designed for maximum penetration of game animals, maximum energy transfer to the animal and/or a combination thereof with minimum lead contamination and a lethal wound channel with minimum trauma to the surrounding tissue for optimized usage of meat. For maximum penetration the bullet normally comprises a single metal or alloy such as brass, lead or copper. The bullet point is usually rounded or flattened. Hunting bullets designed for maximum damage or energy transfer upon impact include soft-point and hollow point expanding bullets.

Expanding projectiles or bullets are designed to expand when traveling through a target, transferring an increased level of kinetic energy to the target. Since an expanding bullet can transfer more of its kinetic energy to the target than can a round-nose bullet, for example, an expanding bullet is less likely to exit the target and cause undesired damage. Further, the expanded bullet causes a larger, more lethal wound channel in the target with increased stopping power. Accordingly, expanding bullets are useful in certain military, law enforcement, and sporting applications.

Hollow-point bullets are expanding bullets that contain a cavity or "hollow-point" at the front of the bullet while soft-point bullets include a soft metal core enclosed by a stronger metal jacket left open at the tip. Upon striking a target, the hollow or soft point is compressed by material from the target, in effect creating a "wedge" or "penetrator" in the center of the bullet. As the hollow- or soft-point bullet travels through the target, the target material is forcefully driven into the hollow or soft point, expanding the front of the bullet outwards from the cavity or core. In this manner, a hollow- or soft-point bullet with sufficient kinetic energy can expand well beyond its original diameter. Further, the loss of kinetic energy due to expansion slows the velocity of the bullet, making it less likely that it will exit the target and cause unintentional damage. At a sufficiently high velocity a hollow- or soft-point bullet may break into two or more pieces, or fragment, while it is traveling through the target, transferring a large portion of its kinetic energy to the target while further reducing the likelihood of unintentional harm beyond the target.

Armor-piercing bullets typically include a hardened penetrator encased in a jacket of copper or similar material. The penetrator is a pointed mass of high-density material designed to retain its shape and carry the maximum possible amount of energy as deeply as possible into the target. Impact velocity of the jacket may temporarily soften the face of the target and cushion the impact to avoid breaking the penetrator, and the penetrator then slides out of the jacket to continue forward through the target.

While mechanical trauma caused by these known projectiles or bullets is generally sufficient for disrupting living targets, it is considerably less effective against electrical devices. In contrast to a living target that experiences pain and may be wounded or incapacitated in a significant manner by a bullet striking any part of the target, electrical devices do not feel pain in response to mechanical trauma and may only be substantively damaged if mechanical trauma is applied to small and specific components within the devices. For example, while the mechanical force of a conventional bullet may slightly destabilize a drone when hit, unless an essential component or electrical circuit of the drone is directly struck and sufficiently damaged the drone may continue to operate.

The need to incapacitate an electrical device is further complicated by the use of redundant electrical systems and partitioned devices. In such electrical devices, even a direct strike to an electrical component of the device may fail to significantly incapacitate the device. Drones may continue to operate if an electrical connection to one of a plurality of propulsion systems is destroyed, if a GPS system is damaged, or if other internal systems are disconnected or damaged due to the presence of back-up systems or protocols, such that several strikes may be required to incapacitate the drone. These challenges are expected to become more significant as development of electrical devices continues, leading to devices with larger profiles, smaller electrical systems, greater partitioning of electrical systems and increased redundancies where the likelihood of a successful strike incapacitating the device is reduced.

Accordingly, there remains a need for a bullet or projectile capable of inflicting a greater disruption to electrical components of electrical devices upon a successful strike to the device, rather than inflicting only limited mechanical trauma as with known bullets. In like manner, there is a need for an electrically disruptive projectile that is relatively inexpensive and simple to use, making an economical substitute for the use of known projectiles.

SUMMARY

Embodiments of the present disclosure advantageously provide electrically disruptive projectiles in the form of a projectile body defining a cavity including an electrically disruptive powder for increasing impairment of electrical signals in a target electrical device with a successful strike. Moreover, these electrically disruptive projectile embodiments can be produced and employed without substantially increasing material or labor costs, instead merely replacing conventional projectiles or bullets with the electrically disruptive projectile embodiments of the disclosure.

According to an embodiment, an electrically disruptive projectile for use in impairing electrical signals in a target electrical device comprises a body defining a cavity. The body may be in the form of a bullet or similar projectile, including materials such as copper, brass, lead, and the like. The cavity may have an opening at a first end of the body, such as in the form of a hollow-point bullet or similar projectiles, and may extend along a longitudinal axis of the body. The cavity may be filled with an electrically disruptive powder and, in some embodiments, a cover or a film may be placed at the opening to secure the electrically disruptive powder therein.

In varying embodiments, the electrically disruptive powder may include a conductive material, a superconductive material, a piezoelectric material, a triboelectric material or a combination of the same. The electrically disruptive powder is configured for disrupting electrical signals, such as by creating new electrical connections on existing circuitry or creating disruptive electrical signals. The electrically disruptive powder may include powdered metals, including one or more of tin, gallium, aluminum, lead, titanium, zinc, copper, iron, chromium, magnesium, ytterbium, bismuth, steel, nickel, molybdenum, zirconium, tungsten, bronze, manganese, nichrome, red iron oxide, or similar materials. The electrically disruptive powder may include powdered piezoelectric materials that exhibit a piezoelectric effect. Piezoelectric materials may include piezocrystals and piezoceramics, such as lead zirconate titanate, quartz and related materials exhibiting a piezoelectric effect. The electrically disruptive powder may include conductive materials such as carbon black, graphite, silicon, or similar materials.

The electrically disruptive projectile may be configured to be fired or otherwise propelled against a target and to disperse the electrically disruptive powder into the target. During penetration of the target, the electrically disruptive projectile expands and releases the electrically disruptive powder into the target. The disclosed embodiments advantageously realize both mechanical and electrical disruption and damage to a target electrical device due to the electrically disruptive powder dispersing onto electrical components of the target, creating new electrical connections and disruptive electrical signals.

In embodiments, the electrically disruptive powder may cause disruptive electrical signals through a piezoelectric effect, a triboelectric effect, or the like. A piezoelectric material may generate an electrical charge under the pressure of impact, such that a piezoelectric burst is released on the electrical components of the target in addition to the disruptive new electrical connections created by the electrically disruptive powder. In a further aspect of varying embodiments, the electrically disruptive powder may lead to the formation of new disruptive electrical connections on electrical components of a target, such as by formation of metal whiskers, additional conductive paths or the like.

Embodiments may include configuration of the electrically disruptive powder in the cavity of the body in a manner as to increase a dispersion of the electrically disruptive powder into the target over an area greater than the projectile path, advantageously increasing the likelihood of a successful strike relative to known projectiles.

According to embodiments of a method for forming electrically disruptive projectiles, a projectile body may be provided defining a cavity. An electrically disruptive powder may be added to the cavity and secured therein by a cover or a film at an opening of the cavity. The cavity may be filled with the electrically disruptive powder by iteratively adding powder, vibrating the body to settle the powder, and tamping the powder in the cavity until the cavity is filled to a desired level.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not, therefore, to be considered to be limiting in scope, embodiments will be described and explained with additional specificity and details through the use of the accompanying drawings in which.

Figure 1:
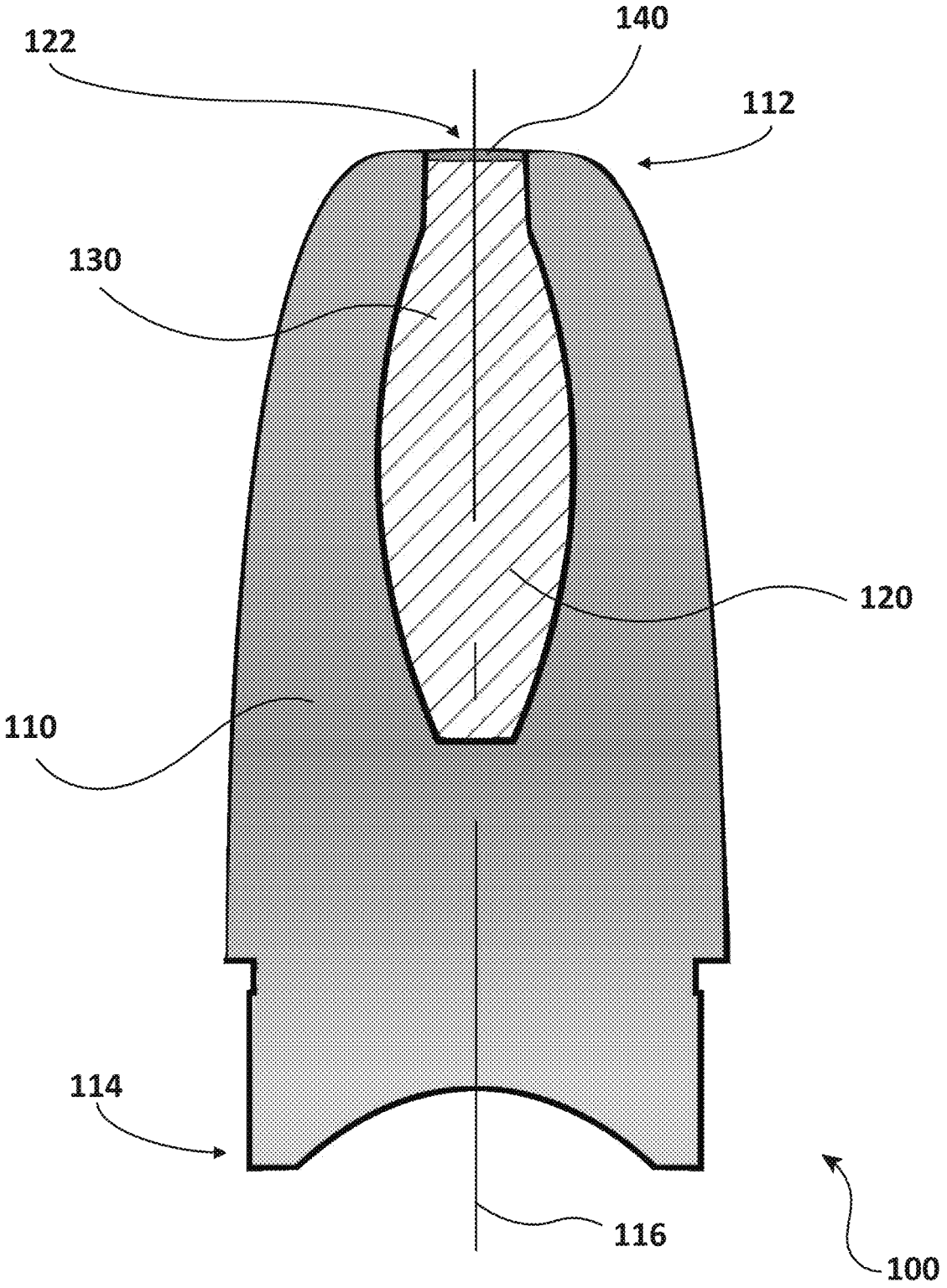
FIG. 1 is a cutaway view of an electrically disruptive projectile according to an embodiment of the disclosure.

The drawing figures are not necessarily drawn to scale, but instead are drawn to provide a better understanding of the components, and are not intended to be limiting in scope, but to provide exemplary illustrations. The figures illustrate exemplary configurations of electrically disruptive projectiles and related methods, and in no way limit the structures or configurations of electrically disruptive projectiles and methods according to the present disclosure.

DESCRIPTION

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. It should be understood, however, that there is no intention to limit the disclosure to the specific embodiments disclosed, but on the contrary, the intention covers all modifications, alternative constructions, combinations, and equivalents falling within the spirit and scope of the disclosure. The dimensions, angles, and curvatures represented in the figures introduced above are to be understood as exemplary and are not necessarily shown in proportion. The embodiments of the disclosure may be adapted or dimensioned to accommodate use with different weapons, cartridges, etc., as would be understood from the present disclosure by one skilled in the art.

It will be understood that unless a term is expressly defined in this application to possess a described meaning, there is no intent to limit the meaning of such term, either expressly or indirectly, beyond its plain or ordinary meaning. Unless defined otherwise, all technical and scientific terms used herein have the same meaning as commonly understood by one of ordinary skill in the art to which the present disclosure pertains. Although a number of methods and materials similar or equivalent to those described herein can be used in the practice of the present disclosure, the preferred materials and methods are described herein.

It is to be noticed that the term "comprising," which is synonymous with "including," "containing," "having" or "characterized by," should not be interpreted as being restricted to the means listed thereafter; it does not exclude other or additional, unrecited elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present disclosure, the relevant components of the device are A and B.

It will be noted that, as used in this specification and the appended claims, the singular forms "a," "an" and "the" include plural referents unless the content clearly dictates otherwise. Thus, for example, reference to a "blade" includes one, two, or more blades.

Reference throughout this specification to "one embodiment," "one aspect," or "an embodiment" means that a particular feature, structure or characteristic described in connection with the embodiment is included in at least one embodiment of the present disclosure. As used herein, the term "embodiment" or "aspect" means "serving as an example, instance, or illustration," and should not necessarily be construed as preferred or advantageous over other embodiments disclosed herein. Thus, appearances of the phrases "in one embodiment," "in one aspect," or "in an embodiment" in various places throughout this specification are not necessarily all referring to the same embodiment but may. Furthermore, the particular features, structures or characteristics may be combined in any suitable manner, as would be apparent to one of ordinary skill in the art from this disclosure, in one or more embodiments.

Similarly, it should be appreciated that in the description of exemplary embodiments of the disclosure, various features of the disclosure are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the embodiments require more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this disclosure.

Furthermore, while some embodiments described herein include some, but not other features included in other embodiments, combinations of features of different embodiments are meant to be within the scope of the disclosure, and form different embodiments, as would be understood by those in the art. For example, in the following claims, any of the claimed embodiments can be used in any combination.

In the description provided herein, numerous specific details are set forth. However, it is understood that embodiments of the disclosure may be practiced without these specific details. In other instances, well-known methods, structures and techniques have not been shown in detail in order not to obscure an understanding of this description.

The various embodiments of the disclosure relate to electrically disruptive projectiles or bullets for use with firearms or related devices for expelling or propelling a projectile. The electrically disruptive projectiles cause signal disruption in electronic and computing systems of a target electrical device in addition to mechanical damage, resulting in an increased per strike disruption to operation of the target as compared to known projectiles. Moreover, the disclosed embodiments may be produced and used without significantly increasing material or labor costs, instead merely replacing conventional bullets with the projectile embodiments of the disclosure.

Depicted in FIG. 1 is an embodiment of an electrically disruptive projectile 100 incorporating features of the present disclosure. As discussed below in more detail, projectile 100 is configured to penetrate a target having electrical components and apply an electrical disruption thereto. Projectile 100 generally comprises a body 110 defining a cavity 120 therein. The cavity 120 may include an opening 122 at a first end 112 of the body 110. An electrically disruptive powder 130 may be provided in the cavity 120 of the body 110.

It will be appreciated that the body 110 may be made of, jacketed with, or otherwise include brass, copper, lead, related alloys, or any other suitable material and combinations thereof as may be used in conventional bullets. Further, the body 110 may be dimensioned or shaped according to the requirements and bore of known firearms, cartridges and related instruments. In like manner, a size and shape of the cavity 120 and/or the body may vary according to attributes of an intended target, for example based on a desired penetration of a particular exterior material, as would be understood by one skilled in the art from the present disclosure. The electrically disruptive projectile 100 is thus advantageously adaptable and/or reconfigurable for different applications.

An electrically disruptive powder 130 according to the present disclosure may include a conductive material, a superconductive material, a triboelectric material, and/or a piezoelectric material capable of disrupting electrical signals. For example, the electrically disruptive powder 130 may comprise powdered metals, including one or more of tin, gallium, aluminum, lead, titanium, zinc, copper, iron, chromium, magnesium, ytterbium, bismuth, steel, nickel, molybdenum, zirconium, tungsten, bronze, manganese, nichrome, red iron oxide, or similar materials.

While described for convenience in the current disclosure as a powder, it should be appreciated that the electrically disruptive powder 130 may be provided in any form suitable for dispersion onto electrical traces or circuits within a target, including fine particles produced by grinding, crushing or disintegration of a solid substance as well as fine particles produced by crystallization or related techniques. The electrically disruptive powder 130 may therefore be provided in the form of flakes, pellets, or similar fine particles of any suitable shape, as would be understood from the instant disclosure.

In certain embodiments, the electrically disruptive powder 130 may have a powder mesh of 400 to 230. The electrically disruptive powder may comprise particles having a maximum dimension of less than 1,000 μm, and/or an average particle size of between 35 μm and 55 μm, more particularly between 40 μm and 50 μm, for example 44 micron or 325 mesh.

The electrically disruptive powder 130 may include piezoelectric materials that exhibit a piezoelectric effect. These piezoelectric materials are solid materials that accumulate an electric charge in response to applied mechanical stress. Piezoelectric materials according to disclosed embodiments may include piezocrystals and piezoceramics, such as lead zirconate titanate, quartz and related materials exhibiting a piezoelectric effect, but are not limited thereto.

The electrically disruptive powder 130 may include triboelectric materials that exhibit a triboelectric effect. These triboelectric materials are solid materials that accumulate an electric charge in response to separation from another material. Triboelectric materials according to disclosed embodiments may include combinations of lead, copper, aluminum, polytetrafluoroethylene (PTFE) and similar materials exhibiting a triboelectric effect but are not limited thereto. In a specific example, the electrically disruptive powder may comprise a mixture of lead powder, PTFE powder, and carbon black powder.

According to varying embodiments, the electrically disruptive powder 130 may fill the cavity 120 or may fill only a portion of the cavity 120. The electrically disruptive projectile 100 may include at least 0.5 g of the electrically disruptive powder 130, at least 1.0 g of the electrically disruptive powder 130, between 0.5 g and 2.0 g of the electrically disruptive powder 130, between 0.5 g and 1.5 g of the electrically disruptive powder 130, between 0.75 g and 1.25 g of the electrically disruptive powder 130, or about 1 g of the electrically disruptive powder 130.

As shown in FIG. 1, a cover or a film 140 may be applied to the opening 122 to close the cavity 120 or otherwise reduce a dimension of the opening 122, such that the electrically disruptive powder 130 is retained in the cavity 120. The cover 140 may comprise a film, a cap, a ballistic tip, or the like.

A film may include an adhesive, an epoxy resin, a polymeric film or similar material capable of securing the electrically disruptive powder 130 in the cavity 120 in response to gravity and forces of related strength. The film 140 may have a thickness of less than 2 mm, less than 1 mm, less than 0.5 mm, between 0.5 mm and 2 mm, or between 0.25 mm and 0.75 mm. It should be noted that, although the film 140 may extend to some degree into the cavity 120 as well as the electrically disruptive powder 130 therein, the electrically disruptive powder 130 of the described embodiments remains substantially free from adhesive or other connections, such that the powder 130 remains primarily in the form of individual and distinct particles, although they may be loosely packed in the cavity 120.

A ballistic tip may include a conventional ballistic tip as may be coupled with a conventional hollow point projectile, whether using a tension fit, an adhesive, or another coupling mechanism. A ballistic tip may be provided in the form of a cone shaped element, a spherical shaped element, or an element of any other suitable shape for insertion into the opening of the hollow point projectile, such as formed of plastic, metal or another suitable material. In this manner, the ballistic tip may provide a cover 140 for closing the electrically disruptive powder within the cavity 120 while also providing additional benefits relating to aerodynamics, penetration and the like, as would be understood by the skilled person informed by the present description.

Embodiments of the electrically disruptive projectile 100 are configured to be fired or otherwise propelled against a target and to disperse the electrically disruptive powder 130 into the target during impact therewith. As such, it should be understood that the electrically disruptive projectile 100 may be provided with or in a cartridge, including a propellant, an ignition device, and a case, for firing from a firearm. Properties of the cartridge may be configured to achieve desired ballistic characteristics according to the level of skill in the art, as would be understood by the skilled person informed by the present description.

Figure 2:
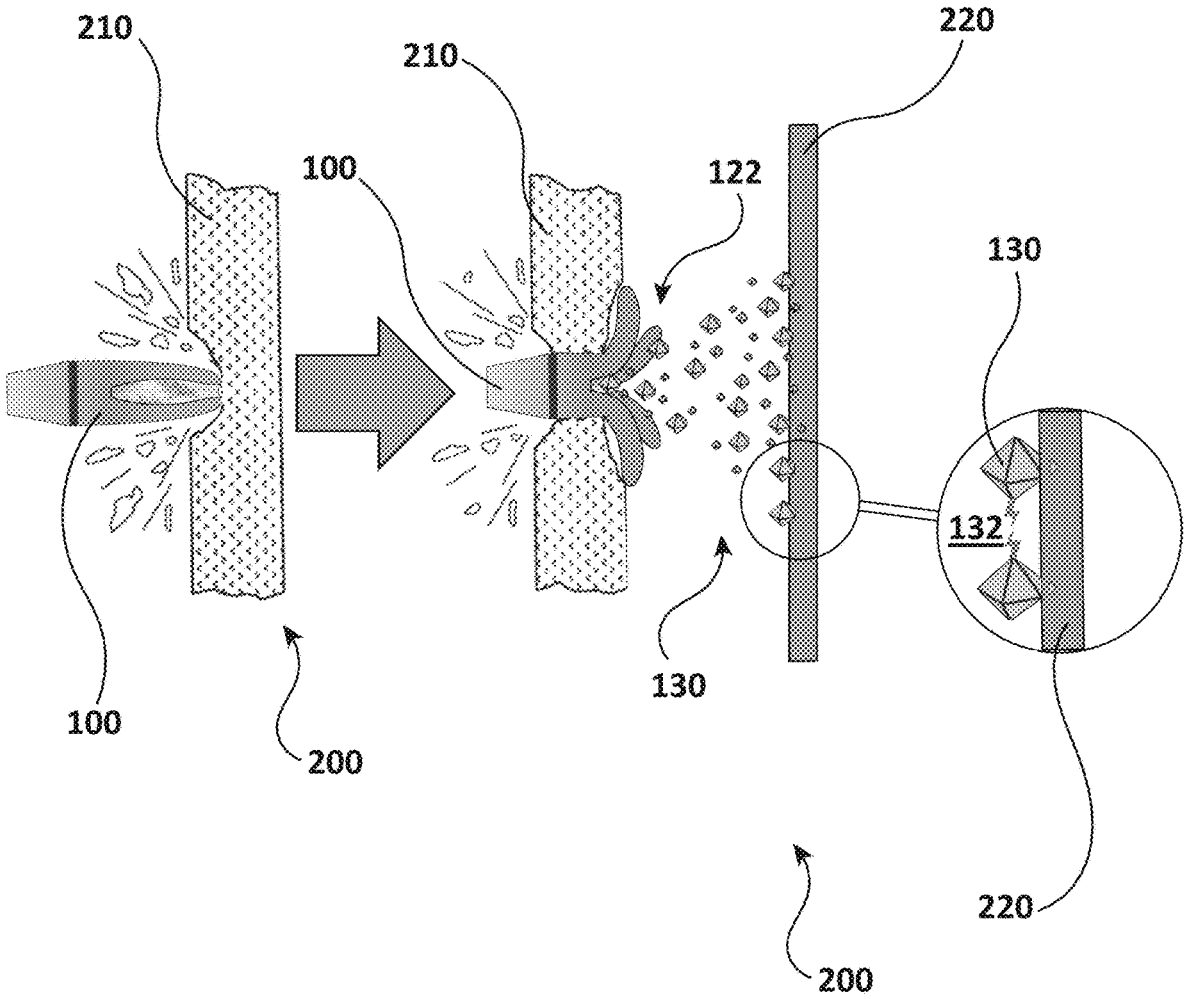
FIG. 2 is a flow diagram illustrating impact of the disruptive projectile embodiment of FIG. 1 against a target.

As illustrated in FIG. 2, the electrically disruptive projectile 100 may be fired at a target 200 and forcibly penetrate an exterior 210 of the target 200. During penetration by the electrically disruptive projectile 100, the opening 122 of the cavity 120 is forcibly expanded by the resistance of the exterior 210 of the target 200 to the first end 112 of the body 110. As the opening 122 expands and the projectile 100 penetrates into an interior of the target 200, the electrically disruptive powder 130 is forcibly dispersed within the target 200.

Advantageously, rather than simply inflicting mechanical trauma on the target 200, the electrically disruptive powder 130 creates new electrical connections 132 and/or signals on electrical components 220, such as electrical circuits, traces, metallic whiskers, or related elements, within the target 200. For example, tin whiskering and zinc whiskering may occur with impact forces and heat, such that the tin or zinc is heated due to an impact force, which induces whiskering inside the target 200, such as on existing electrical circuits to create new electrical connections 132. In another example, a thermal mixture of zirconium, aluminum, and magnesium may be used as the electrically disruptive powder 130, such that heat is generated with either air friction or impact sufficient to melt then weld in place fragments from the projectile and/or parts of the target 200 to create new electrical connections 132. These new electrical connections 132 impede existing signal paths within the target 200 and cause disruptive electrical signals to interrupt normal operation of the target 200. Further, the pressures exerted on the electrically disruptive powder 130 during penetration of the exterior 210 of the target 200 may cause a piezoelectric material and/or a triboelectric material included in the electrically disruptive powder 130 to generate an electric charge, such that new disruptive electric signals are created in the form of a burst of piezoelectricity and/or triboelectricity from embodiments of the electrically disruptive powder 130 containing piezoelectric material and/or triboelectric material. Such an electric charge may be on the order of 10V or 20V, or from 10V to 20V, although the electric charge may be configured to a desired level by a selection of material and quantities thereof and are not limited to any particular voltage.

These electrical connections 132 and disruptive electrical signals can effectively incapacitate the electrical components 220 of the target 200. Surprisingly, the disruption caused by projectile embodiments of the current disclosure may have a more significant incapacitating effect than mechanical destruction of the electrical components 220. Rather than losing a single electrical component 220 to destruction as may be expected, the described projectile embodiments can cause electrical disruptions to be communicated through the circuitry of the target 200 itself to additional electronic components and systems, in an ongoing and persistent manner. Accordingly, partitioning the electrical components 220 or the use of redundant systems in the target 200 are less effective at mitigating damage and disruption caused by the disclosed electrically conductive projectiles 100 than simple mechanical damage.

The electrically disruptive powder 130 further improves the likelihood of a successful strike on the target 200. While conventional bullets or projectiles are generally only capable of inflicting damage or disruption in a limited channel or path through the target 200, the electrically disruptive powder 130 of the disclosed embodiments may disperse and spread within the target 200, reaching electrical components 220 that may not lie within a narrower channel or path of the body 110 alone.

As previously indicated, it will be appreciated that embodiments of electrically disruptive projectiles of the present disclosure may be adapted for use according to the requirements and bore of known firearms, cartridges and related instruments. As such, the electrically disruptive projectiles may be dimensioned for any conventional caliber or gauge, such as a 9 mm round, a 10 mm round, a 357 cal round, a 40 cal round, a 45 cal round, a 50 cal round, a 5.56 cal round, a 20-gauge shell, a 28-gauge shell, a 12-gauge shell, etc. A size and shape of the cavity 120 and/or the body 110 may vary according to attributes of an intended target, for example based on a desired penetration of a particular exterior material or a desired quantity of eclectically disruptive powder 130, as would be understood by one skilled in the art from the present disclosure.

According to varying embodiments, the cavity 120 may extend along an axis 116 of the body 110 from the first end 112 in a direction towards a second end 114 of the body 110 opposite the first end 112. A volume of the cavity 120 may increase towards the opening 122, may be constant, or may decrease according to a desired penetration and dispersion of the electrically disruptive powder 130 into the target 200.

Figure 3:
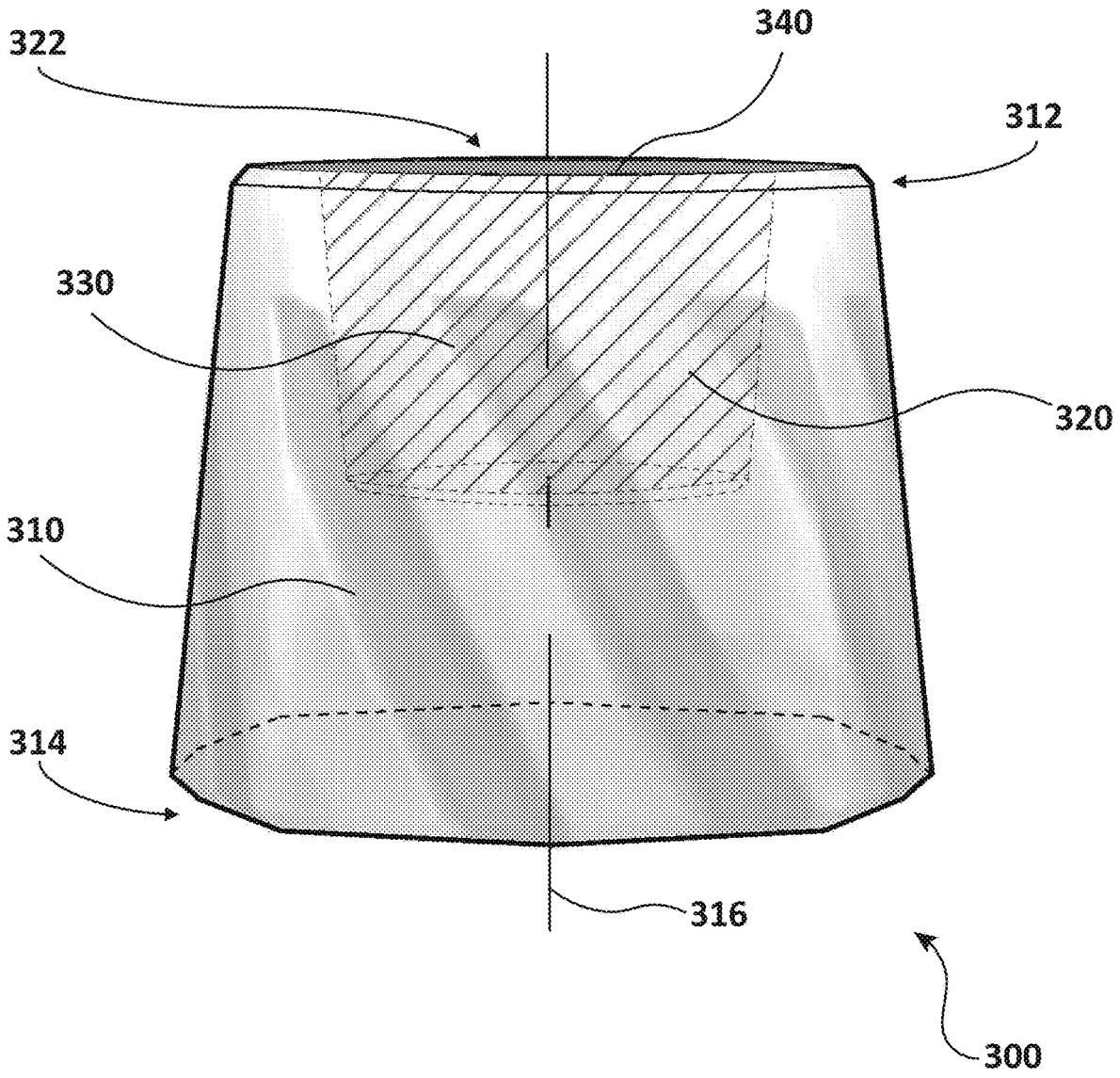
FIG. 3 is a cutaway view of an electrically disruptive projectile according to another embodiment of the disclosure.

FIG. 3 illustrates another embodiment of an electrically disruptive projectile 300, such as may be configured for use as a slug or shot in a smooth bore firearm. As discussed with respect to the embodiment of FIG. 2 in more detail, projectile 300 is configured to penetrate a target having electrical components and apply an electrical disruption thereto. Projectile 300 generally comprises a body 310 defining a cavity 320 therein. The cavity 320 may include an opening 322 at a first end 312 of the body 310. An electrically disruptive powder 330 may be provided in the cavity 320 of the body 310.

As shown in FIG. 3, the cavity 320 may have a volume that increases towards the opening 322 at the first end 312, forming a concave cavity or funnel shaped profile. In this manner, the projectile 300 may be configured to expand or flare outwards on impact with a target, such that the opening 322 and the cavity 320 expand and the force of a second end 314 of the body 310 projects the electrically disruptive powder 330 forward in a radiating cone, improving a spread of the electrically disruptive powder 330 within the target.

As understood from previously described embodiments, the embodiment of FIG. 3 may include a cover or film 340 applied to the opening 322 to close the cavity 320 or otherwise reduce a dimension of the opening 322, such that the electrically disruptive powder 330 is retained in the cavity 320. The film 340 may comprise an adhesive, an epoxy resin, a polymeric film or similar material capable of securing the electrically disruptive powder 330 in the cavity 320 in response to gravity and forces of related strength. In varying aspects, the cover 340 may comprise a ballistic tip, as would be understood by the skilled person informed by the present description.

Figure 4:
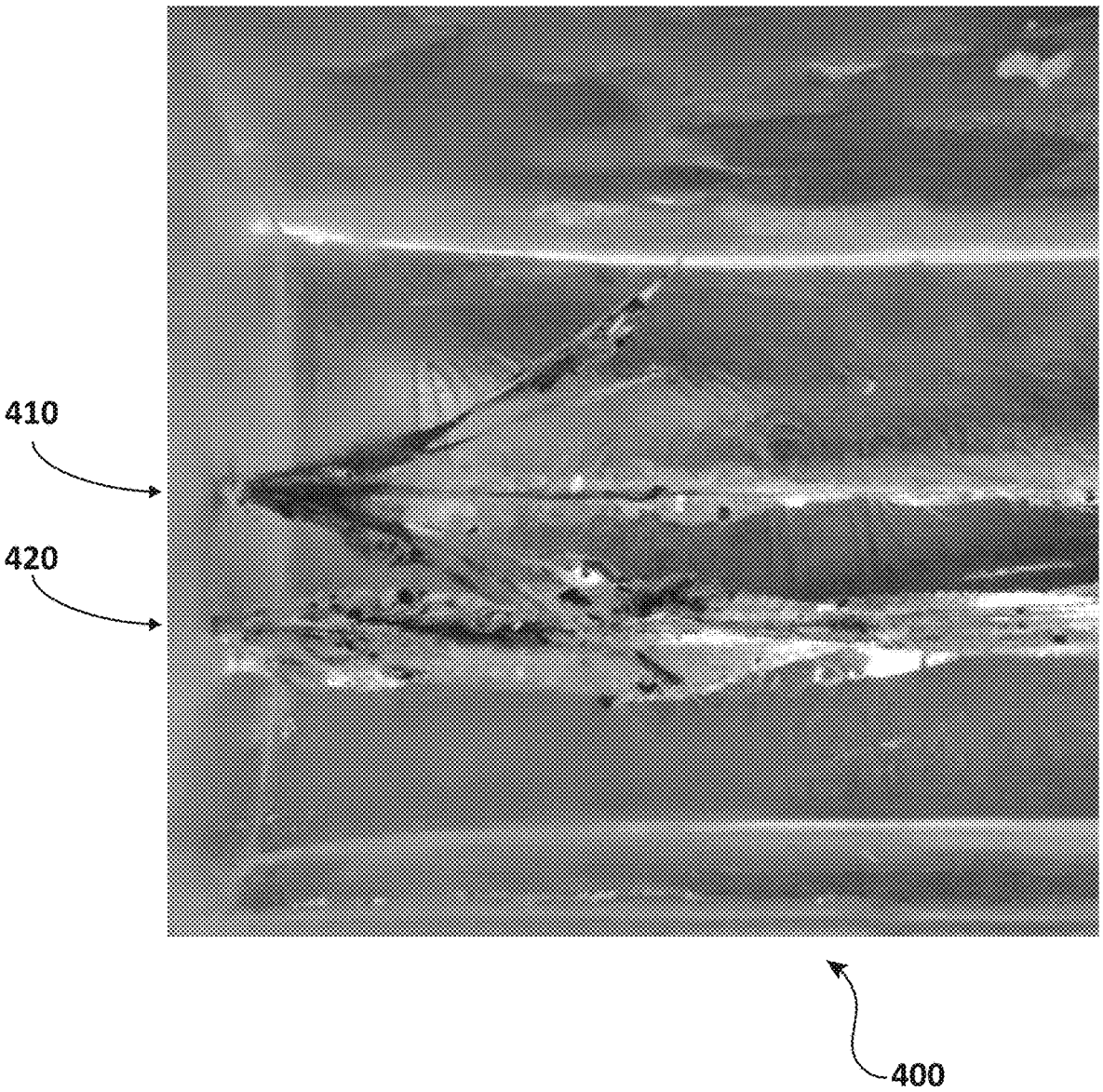
FIG. 4 is a photograph of a test of multiple electrically disruptive projectiles according to the disclosure using ballistic gel.

It is noted that the electrically disruptive projectiles of the current disclosure advantageously exhibit desired ballistic characteristics comparable to conventional bullets or ammunition and are not impaired by the addition of the electrically disruptive powder. As shown in FIG. 4, embodiments of electrically disruptive projectiles according to the present disclosure were tested using ballistic gel 400 from a distance of 25 feet. A first channel 410 was created by a 9 mm Luger hollow-point round filled with a piezoelectric crystal powder. The first channel 410 demonstrates an expected penetration and expansion of the bullet as with conventional bullets and evidences powder deposition into the ballistic gel 400 in a radiating or flared cone shape. Notably, bullet fragments created pathways for the powder to spread against the continued resistance of the ballistic gel 400, illustrating the momentum acting on the powder and an expected trajectory within an electrical device.

A second channel 420 was created by a 0.45 Auto hollow-point round filled with a piezoelectric crystal powder. The second channel 420 demonstrates an expected increase in penetration distance relative to the first channel 410 due to the increased power of the round. Similarly, powder deposition into the ballistic gel 400 is deeper and more linear, with the powder expanding outwards along the path of the bullet.

Figure 5:
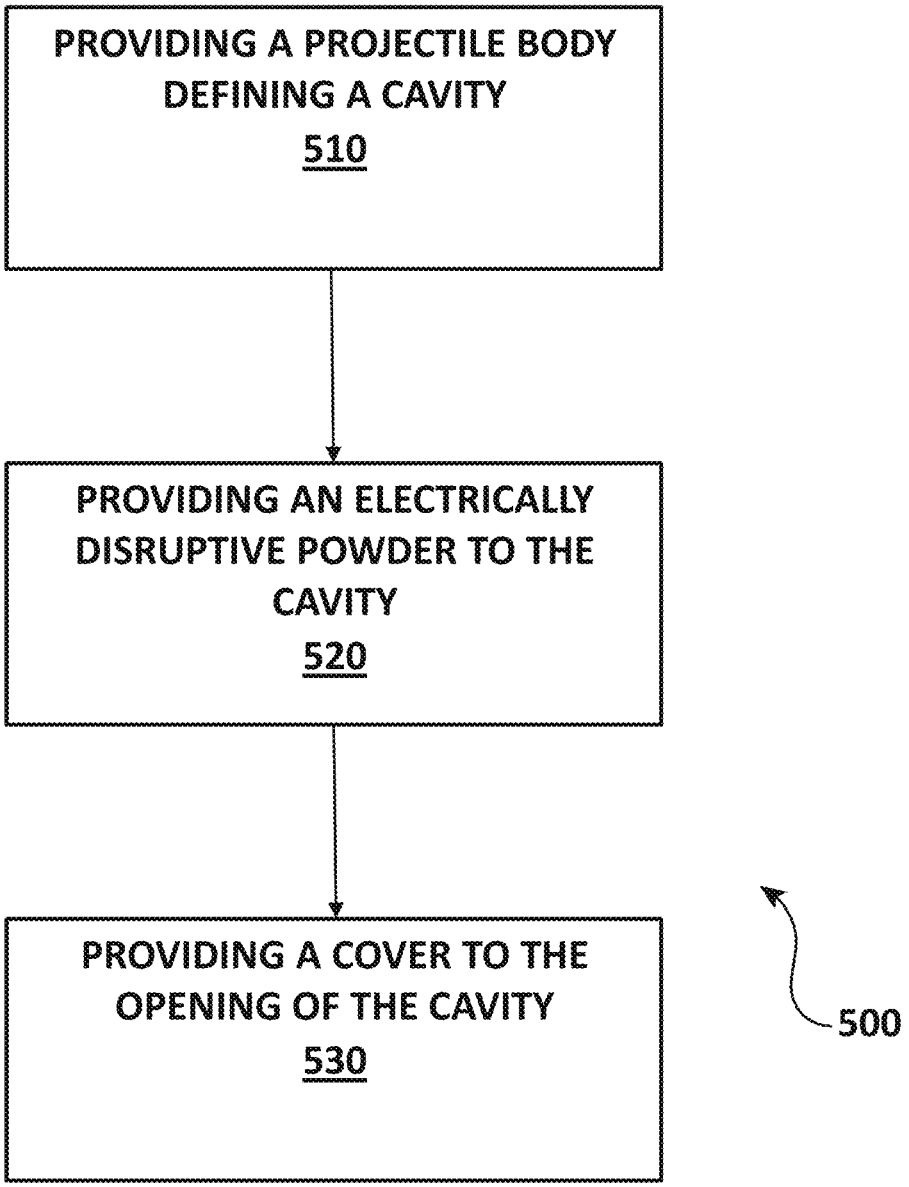
FIG. 5 is flow diagram of a method of forming an electrically disruptive projectile according to embodiments of the disclosure.

FIG. 5 illustrates a flow chart of a method 500 for forming electrically disruptive projectiles of the current disclosure. According to steps of the disclosed method, a body of a projectile is provided 510 defining a cavity therein. The body may be provided in the form of a pre-manufactured bullet or even a pre-manufacture round including a bullet and a casing.

An electrically disruptive powder may be provided 520 to the cavity. According to varying embodiments of the method, the electrically disruptive powder may fill all or only a portion of the cavity. Providing the electrically disruptive powder to the cavity may include iteratively adding powder to the cavity, vibrating the body to settle the powder, and tamping the powder into the cavity. These steps may be repeated to reach a desired load and compaction of powder in the cavity. As the powder is intended to be dispersed on striking a target, the powder may only be compressed with up to 20 lbs of pressure, or up to 10 lbs of pressure, or up to 5 lbs of pressure, or between 5 lbs and 20 lbs of pressure, or between 5 lbs and 10 lbs of pressure, resulting in a loosely packed powder in which particles remain distinct. The described compaction allows for an advantageous spread or dispersion on impact and penetration of a target, while increasing a quantity of powder that can be loaded into the cavity.

A cover may be provided 530 to an opening of the cavity to secure the electrically disruptive powder therein. The cover may comprise a film, a cap, and/or a ballistic tip.

A film may be applied as a drop of adhesive, epoxy resin or the like that cures or dries at the opening, or may be directly applied in the form of a film, such as with an accompanying adhesive or under heat and/or pressure. According to an embodiment, a single drop of epoxy resin may be applied to the opening, although a quantity and type of the film provided may be configured for desired properties, including thickness, etc. In the step of providing the film to the opening of the cavity, penetration of adhesive into the powder or similar effects that may tend to cause clumping or coating of the powder is avoided by the compression of the powder and the selection of the film. In this manner, the advantageous dispersion properties of the powder are preserved while the powder is secured within the cavity.

Figure 6:
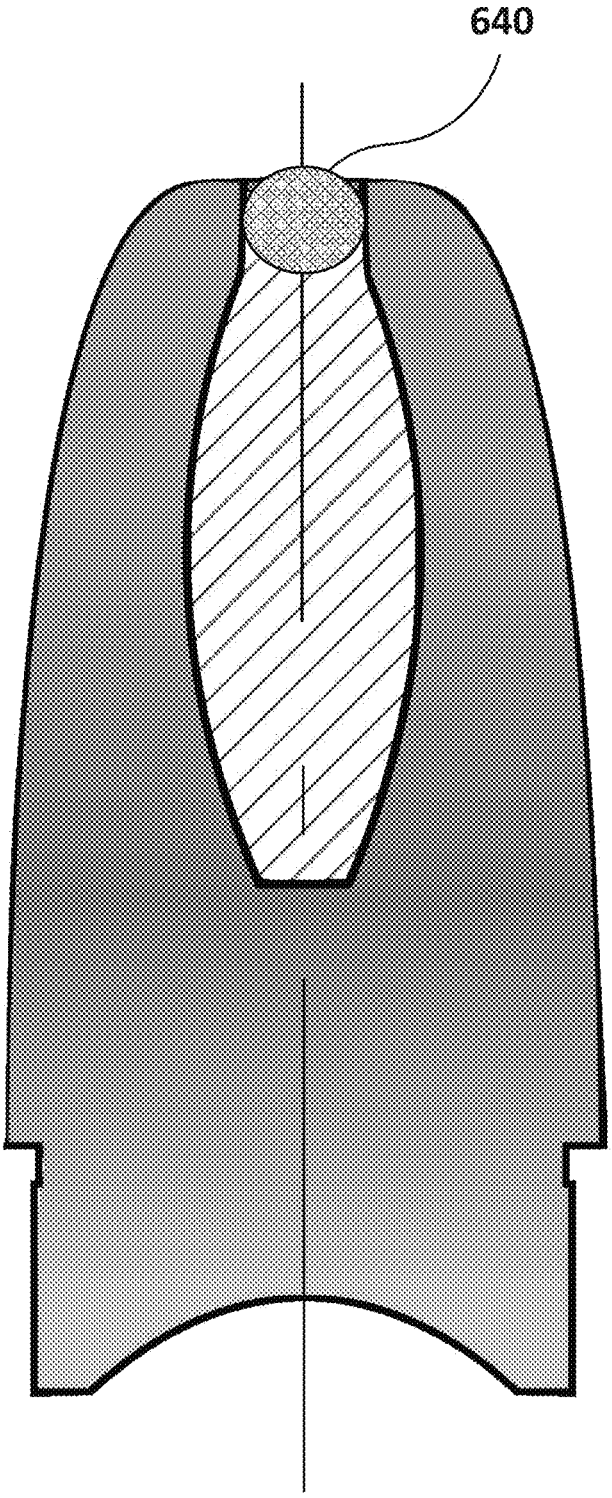
FIG. 6 is a cutaway view of an electrically disruptive projectile according to an embodiment of the disclosure.

According to the embodiment of FIG. 6, a ballistic tip 640 may be inserted into the opening of the cavity and retained by tension with the projectile body, using an adhesive or in another manner as would be apparent to one skilled in the art from the disclosure. The embodiment of FIG. 6 may include any or all of the elements according to the embodiment of FIG. 1, as would be apparent to one skilled in the art from the current disclosure. The ballistic tip 640 may close the opening of the cavity and secure the electrically disruptive powder therein, and may be selected to further customize properties of the projectile, including aerodynamics, penetration, and the like. Although shown as a spherical element, the ballistic tip 640 may be provided in any suitable shape, such as in the form of a cone or the like.

It is to be understood from the current disclosure that the features of the illustrated embodiments may be combined to meet the penetration requirements or characteristics of a particular target, such as accommodating for exteriors of varying thickness and strength. Accordingly, embodiments according to the current disclosure may incorporate variations in size, shape, and/or propellant, as conventionally understood in view of the current disclosure or otherwise in whole or in part from one embodiment to another.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

The invention claimed is:

1. An electrically disruptive projectile comprising:
a body defining a cavity therein; and
an electrically disruptive powder provided in the cavity of the body;
wherein the electrically disruptive powder comprises a piezoelectric material.

2. The electrically disruptive projectile of claim 1, wherein the electrically disruptive powder comprises piezoelectric crystals.

3. The electrically disruptive projectile of claim 1, wherein the electrically disruptive powder has an average particle size between 35 μm and 55 μm.

4. An electrically disruptive projectile comprising:
a body defining a cavity therein; and
an electrically disruptive powder provided in the cavity of the body;
wherein the electrically disruptive powder comprises one or more of powdered sulfur, silicon, graphene, carbon black, and polytetrafluoroethylene (PTFE).

5. The electrically disruptive projectile of claim 4, wherein the electrically disruptive powder has an average particle size between 35 μm and 55 μm.

6. An electrically disruptive projectile comprising:
a body defining a cavity therein; and
an electrically disruptive powder provided in the cavity of the body;
wherein the cavity includes an opening at a first end of the body;
wherein a cover is provided at the opening at the first end of the body;
wherein the cover comprises one or more of an adhesive film, an epoxy resin, and a polymeric film.

7. The electrically disruptive projectile of claim 6, wherein the body is configured to expand at the first end and discharge the electrically disruptive powder on impact.

8. An electrically disruptive projectile comprising:
a body defining a cavity therein; and
an electrically disruptive powder provided in the cavity of the body;
wherein the electrically disruptive powder is loosely packed in the cavity under 5 to 10 lbs of pressure.

9. The electrically disruptive projectile of claim 8, wherein the electrically disruptive powder comprises one or more of powdered tin, gallium, aluminum, lead, titanium, zinc, copper, iron, chromium, magnesium, ytterbium, bismuth, steel, nickel, molybdenum, zirconium, tungsten, bronze, manganese, nichrome, and red iron oxide.

10. An electrically disruptive projectile comprising:
a body defining a cavity therein; and
an electrically disruptive powder provided in the cavity of the body;
wherein the cavity includes an opening at a first end of the body;
the projectile further comprising a cartridge at a second end of the body opposite the first end, the cartridge including a propellant.

11. The electrically disruptive projectile of claim 10, wherein the electrically disruptive powder comprises one or more of powdered tin, gallium, aluminum, lead, titanium, zinc, copper, iron, chromium, magnesium, ytterbium, bismuth, steel, nickel, molybdenum, zirconium, tungsten, bronze, manganese, nichrome, and red iron oxide.

12. The electrically disruptive projectile of claim 10, comprising at least 0.5 g of the electrically disruptive powder.

13. The electrically disruptive projectile of claim 10, comprising at least 1 g of the electrically disruptive powder.

14. The electrically disruptive projectile of claim 10, wherein a cover is provided at the opening at the first end of the body;
wherein the cover comprises a ballistic tip.

15. The electrically disruptive projectile of claim 10, wherein the cavity has a concave shape.

16. The electrically disruptive projectile of claim 10, wherein the cavity extends along a longitudinal axis of the body.

17. The electrically disruptive projectile of claim 10, wherein the electrically disruptive powder has an average particle size between 35 μm and 55 μm.

18. The electrically disruptive projectile of claim 10, wherein the body is configured to expand at the first end and discharge the electrically disruptive powder on impact.

19. A method of forming an electrically disruptive projectile, the method comprising:
providing a body defining a cavity therein;
providing an electrically disruptive powder in the cavity; and
applying a cover to an opening of the cavity;
wherein the step of providing the electrically disruptive powder in the cavity comprises:
filling the cavity with the electrically disruptive powder;
vibrating the body to settle the electrically disruptive powder in the cavity; and
tamping the electrically disruptive powder into the cavity.

20. The method of claim 19, wherein said tamping the electrically disruptive powder into the cavity comprises applying 5 to 10 lbs of pressure.

* * * * *